United States Patent [19]

Crain

[11] Patent Number: 5,052,138

[45] Date of Patent: Oct. 1, 1991

[54] AMMUNITION SUPPLY INDICATING SYSTEM

[76] Inventor: Philip Crain, 1259 7th Pl., Hermosa Beach, Calif. 90254

[21] Appl. No.: 444,829

[22] Filed: Dec. 1, 1989

[51] Int. Cl.[5] ..... F41A 9/62

[52] U.S. Cl. ..... 42/1.02

[58] Field of Search ..... 42/1.01, 1.02, 1.03, 42/1.05; 89/196

[56] References Cited

U.S. PATENT DOCUMENTS

| | | | |
|---|---|---|---|
| 2,627,686 | 2/1953 | Shockey | 89/196 |
| 4,001,961 | 1/1977 | Johnson et al. | 42/1.02 |
| 4,372,192 | 2/1983 | Lienau | 89/1.8 |
| 4,463,655 | 8/1984 | Krieger | 89/196 |
| 4,541,191 | 9/1985 | Morris et al. | 42/1.05 |
| 4,895,064 | 1/1990 | Marzocco | 89/196 |

*Primary Examiner*—Michael J. Carone

*Attorney, Agent, or Firm*—Martin P. Hoffman; Mitchell B. Wasson; Stewart L. Gitler

[57] ABSTRACT

Several embodiments of ammunition supply indicating systems for firearms are disclosed. Each system (1) counts, either automatically or manually, the number of rounds in a magazine introduced into the firearm, (2) detects the movement of a reciprocally movable slide in the firearm to increment a count of "one" for the round entering the firing chamber, and (3) electronically combines the two digits, and (4) displays same on a display panel. The display panel is situated in a thin housing secured to the firearm along the line of sight of the user. A running total of the number of rounds remaining in the firearm is visible to the user. Slide movement may be detected by magnetic, mechanical, optical, or electrical devices, while the number of rounds remaining in the magazine may be monitored by position switches operated by the follower within the magazine. A flashing question mark symbol may be visible on the display panel to alert the user that the magazine has not been inserted into the firearm and/or that a round may be present in the firing chamber.

26 Claims, 5 Drawing Sheets

FIG. 3
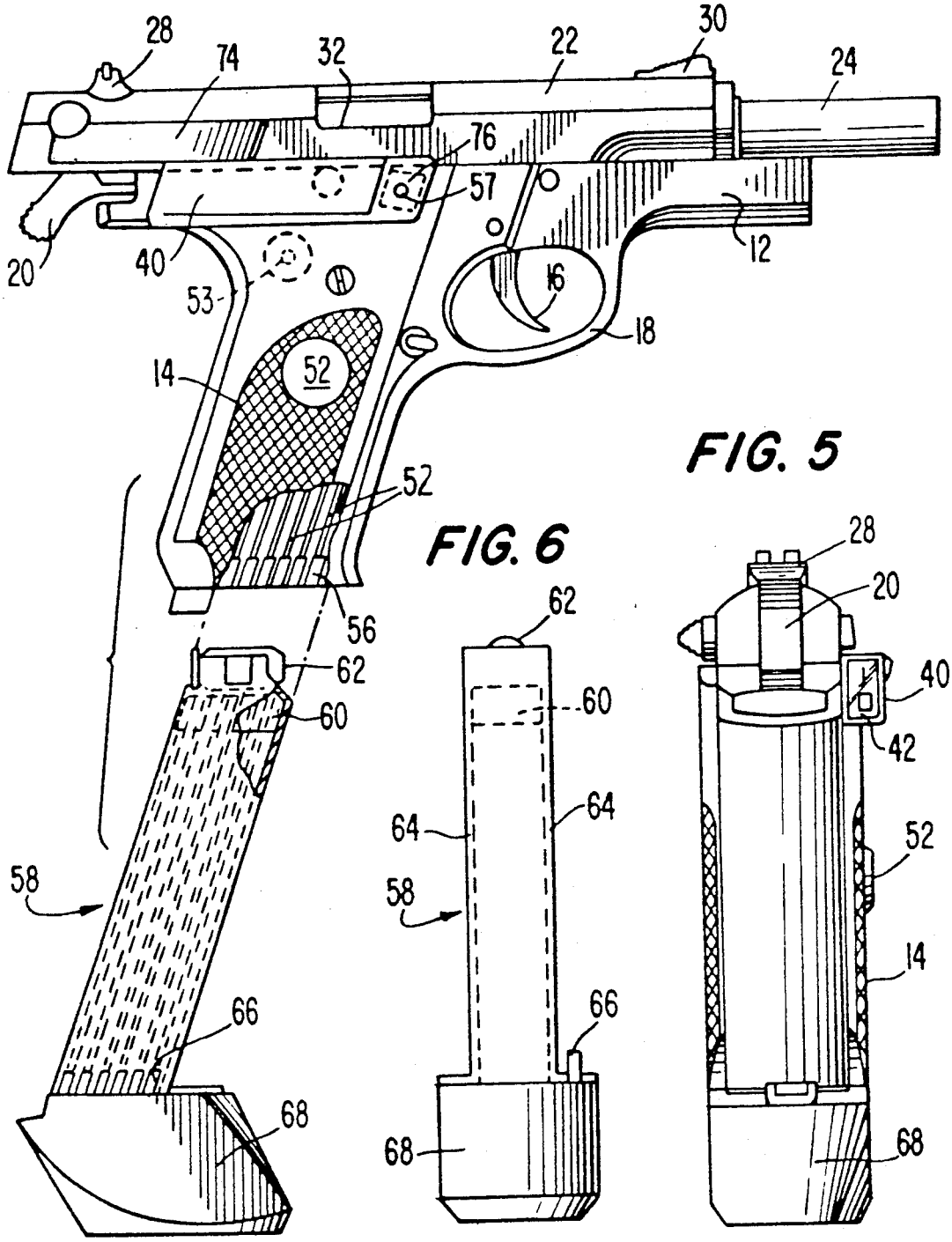
FIG. 5
FIG. 6
FIG. 4
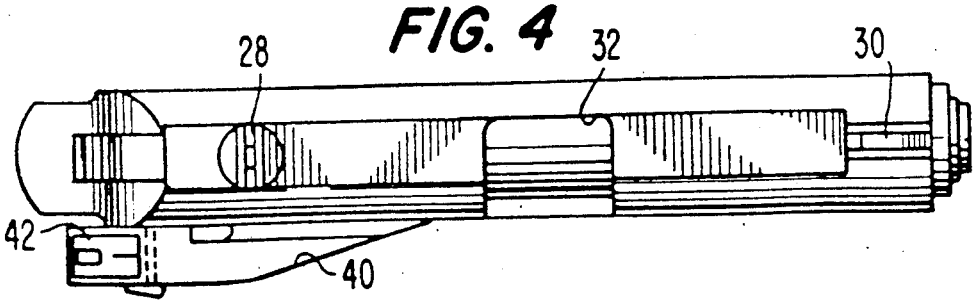

AMMUNITION SUPPLY INDICATING SYSTEM

BACKGROUND OF THE INVENTION

This invention pertains generally to ammunition supply indicating systems for firearms, and, more particularly, to mechanisms for counting, and displaying, the number of rounds available in the weapon for discharge by the user.

Various devices are known for counting the number of rounds discharged from a firearm. In order to ascertain the number of rounds available for discharge, the user of the weapon must know, or ascertain, the number of rounds available when the first round was fired and subtract the number discharged. An error in calculating the number of rounds available to the user can have disastrous repercussions, particularly when the weapon is used in a confrontational setting by a police officer or soldier.

U.S. Pat. No. 4,558,626, granted Dec. 17, 1985, to Rolf Bartolles, discloses a primer cartridge magazine that is removably mounted in the reciprocally movable slider 9 of a wedge-type breech mechanism of the gun. A spring 34 and a guide member 5 in the magazine bias a stack of primer cartridges 4 toward the bottom of the magazine. An insertion opening 14 and an ejection opening 15 are defined at the lower end of the magazine. The magazine has a pair of opposing side walls which define a widened top portion having a pair of indicating windows 20. An indicating disc 2 is rotatably mounted upon a shaft, and indicates, through the viewing windows, the number of primer cartridges in the magazine. Enlarged head 55 on one end of tension bar 6 is connected to a shaft 28 and a bore 26 on one indicating disc. The other end of the tension band is engaged within slot 51 and bore 50 of the guide member 5, as shown in FIGS. 4 and 6. Consequently, the number of cartridges retained within the magazine is clearly indicated.

U.S. Pat. No. 3,552,053, granted Jan. 5, 1971, to K. W. Jarvis, discloses a mechanism for counting the shots fired from a gun such as an M-16 rifle. The device consists of a frame 21 that is clamped to a gun barrel 11, in the manner shown in FIGS. 1 and 2 of the patent. The frame includes a piezoelectric crystal 50 (see FIG. 3) which is stressed by the transient radial expansion of the barrel to produce electrical impulses which are sensed by a threshold detector 22 and counted in a register 100.

U.S. Pat. No. 4,146,987, granted Apr. 3, 1979, to C. M. Hudson and William L. Andre, discloses a counter 2 used to record the number of rounds fired from large-caliber weapons systems. The counter includes a weighted mass 6 that is secured to shaft 4 so that the mass is freely pivotable in only one plane. A coiled spring 8 applies an opposing torque force of a constant, predetermined magnitude to the shaft so that the counter is activated only in response to a resultant torque force of a predetermined magnitude.

SUMMARY OF THE INVENTION

As suggested by the prior art patents discussed previously, several mechanisms are known for counting the number of rounds fired by a gun. Other mechanisms, such as shown in U.S. Pat. No. 4,558,626 are capable of counting, and indicating, the number of rounds in a magazine retained within a gun. The condition of the firing chamber, however, is not considered, and the user is unaware of the total number of rounds available for discharge. In contrast thereto, the instant invention is capable of accurately counting the number of rounds in the magazine, as well as in the firing chamber of the gun, and displaying the total number of rounds available for discharge. The number of rounds available is reduced by one after each round has been fired.

Accordingly, it is a principal object of the invention to provide a readily observable display that clearly indicates the total number of rounds of ammunition available for discharge, taking into account the number of rounds in the magazine and adding a digit for the round in the firing chamber. Miscalculations by the user of the gun regarding the available ammunition are therefore eliminated.

It is another object of the invention to provide an ammunition supply indicator system that can be used with magazine fed pistols or revolvers, with equal success. Furthermore, the invention can be used with other magazine fed firearms as well.

Another object of the invention is to provide an ammunition supply indicator system that can be sold in a kit for enhancement of existing firearms, or may be incorporated directly into the manufacture of the firearms.

Yet another object of the invention is to implement a method of counting the number of rounds available to the user that takes cognizance of the rounds in the magazine and the firing chamber. The count is decremented by "one" every time the firing chamber is uncovered.

Diverse mechanisms are disclosed by the instant invention for sensing the longitudinal movement of the slide in a weapon, such as a pistol, that employs a slide to cover the firing chamber in the barrel of the weapon which accepts each round fed from the magazine. The forward, and rearward, movement of the slide affects the total number of rounds indicated on the display panel of the weapon. Mechanical, magnetic, optical, and other sensing techniques are employed to detect the forward and rearward movement of the slide.

The number of rounds in the weapon is displayed on a two-digit display panel situated on the weapon in an accessible location. Solid state electronics, including a microprocessor, accurately control the display, and provide a running total of the available ammunition.

The display panel may be positioned, either temporarily or permanently, in the direct line of sight with the target, as the shooter normally aims his hand gun or rifle. The display panel is relatively thin and small and does not interfere with the normal usage of the weapon.

The present invention can function satisfactorily with a conventional magazine, for, in some embodiments, the number of rounds in the magazine is manually entered by the user. However, for greater reliability, the conventional magazine is replaced by a specially modified magazine using follower position switches to count the number of rounds. The modified magazine co-acts with complementary contacts defined within the interior of a hand grip adopted to receive the modified magazine.

The display housing is mounted for pivotable movement, so that the user can readily adjust same. Also, the display panel is recessed, so that the illumination thereof will not be visible to opponents of the user of the weapon. A switch may be incorporated into the hand grip of the weapon, so that release of the switch opens a circuit and turns off the display, as occurs when the gun is stored or otherwise not in use.

The instant ammunition supply indicating system is a valuable asset to the user of the firearm, for such system can be manufactured and/or installed in an economically feasible fashion, is reliable and accurate in operation, and has numerous applications for the military, the police, target shooters, hunters, and firearms enthusiasts in general.

BRIEF DESCRIPTION OF THE DRAWINGS

FIG. 3 is a right side elevational view of the pistol of FIG. 1 with a portion of the hand grip broken away to reveal the interior thereof, and further showing the magazine prior to insertion into the interior of the hand grip;

FIG. 4 is a top plan view of the pistol of FIG. 1;

FIG. 5 is a rear elevational view of the pistol of FIG. 1;

FIG. 6 is a rear elevational view of the magazine shown in FIG. 3;

DESCRIPTION OF THE PREFERRED EMBODIMENT

Figure 1:
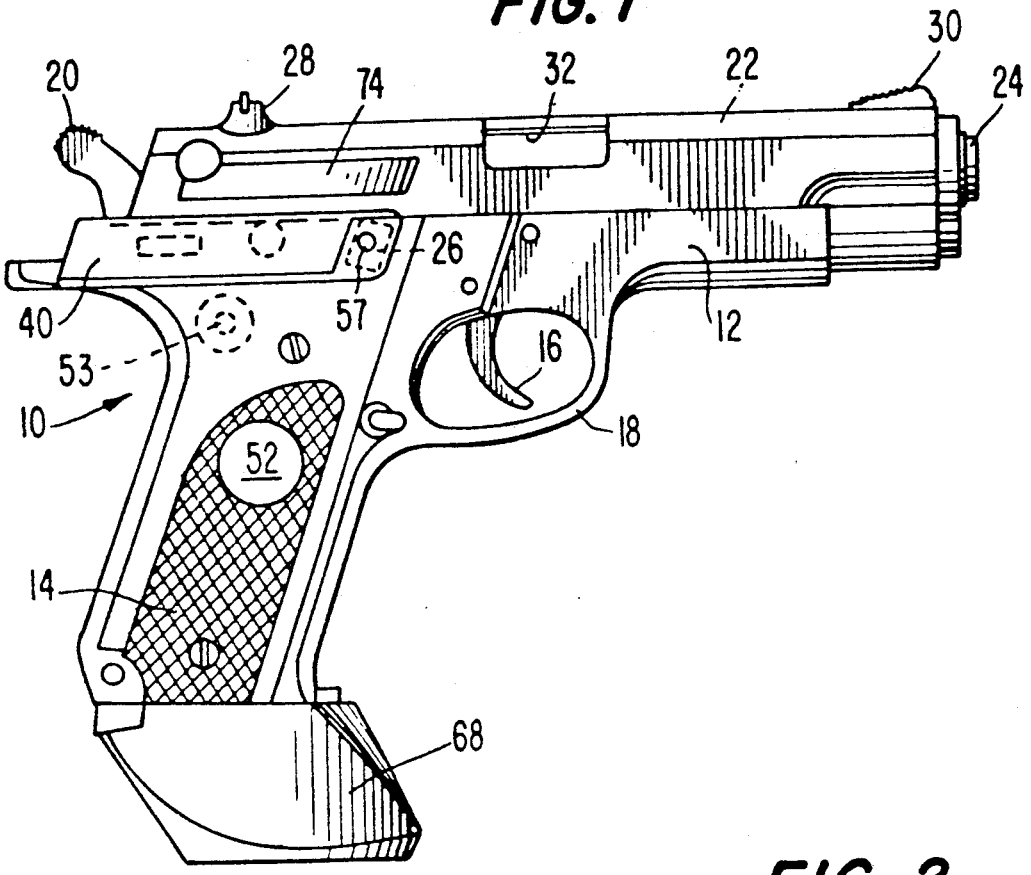
FIG. 1 is a right side, elevational view of a magazine-fed pistol employing the preferred embodiment of the ammunition supply indicating system.

FIGS. 1–7 depict the preferred embodiment of a unique ammunition supply indicator system. The magazine-fed pistol shown in FIGS. 1–7 is merely illustrative of a wide variety of magazine-fed firearms to which the system may be applied. The system may be sold as an after-market kit, or accessory, to be incorporated into existing firearms, or, may be installed in the factory as original equipment for an enhanced magazine-fed firearm.

FIGS. 1–6 show a magazine-fed pistol 10 comprising a body 12, a hand grip 14, a trigger 16, a trigger guard 18, and a hammer 20. A slide 22 is mounted for longitudinal reciprocal movement along barrel 24 with respect to body 12. A safety catch 26 prevents movement of slide 22 in response to activation of trigger 16 until the catch is manually shifted to its released position.

Figure 2:
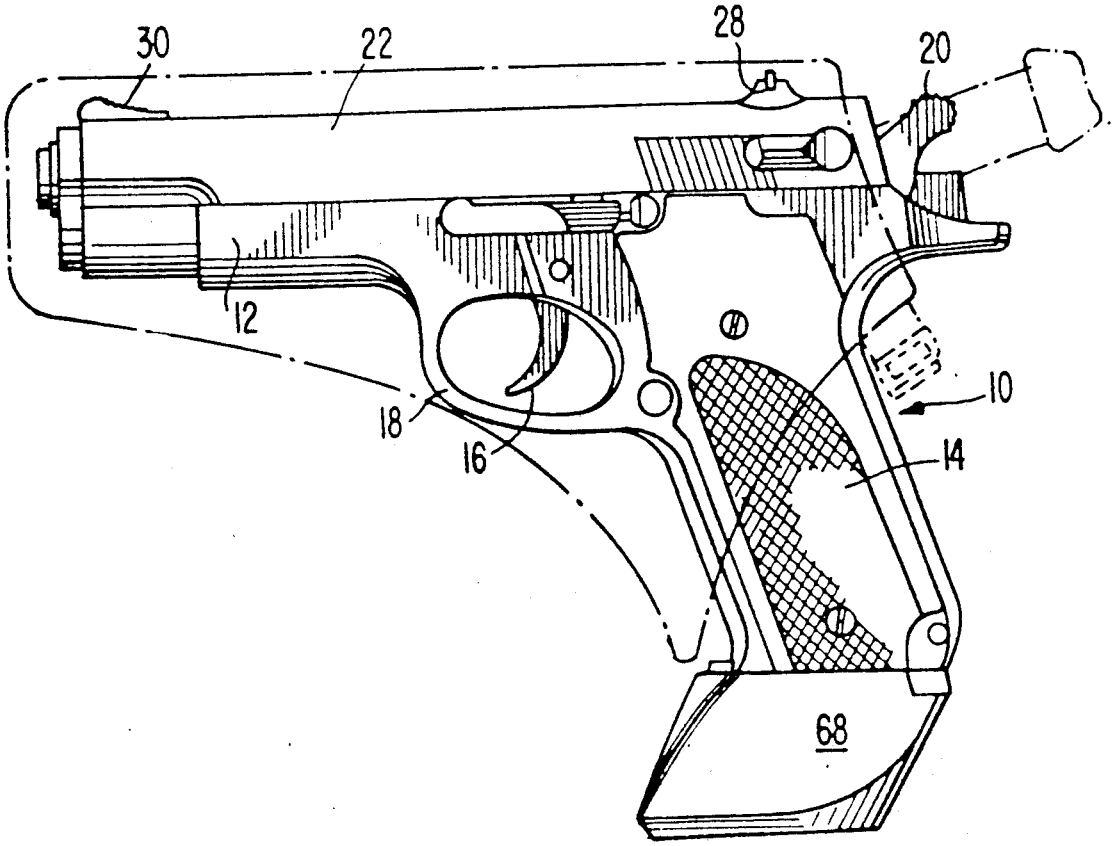
FIG. 2 is a left side, elevational view of the pistol with the ammunition supply indicating system of FIG. 1, such view showing a holster for the pistol in dotted outline.

FIGS. 1 and 2 show slide 22 in its forward position, while FIG. 3 shows the slide in its rearward position. The slide moves between these two positions of extreme movement. A rear sight 28 and a forward sight 30 are located on the upper surface of slide 22, and an aperture 32 is defined in the left side and top of the slide. The aperture 32 is aligned with the firing chamber (not shown) within the body of the pistol during the rearward travel of slide 22, so that a casing can be ejected after the bullet has been fired through barrel 24. Bullets are retained in a magazine inserted into the hollow interior of the hand grip 14, and are fed serially into the firing chamber, in response to the repeated operation of slide 22. Recoil springs (not shown) may be disposed between the slide 22 and the gun body 10 to absorb the explosive forces produced when the hammer causes the powder in the cartridge to ignite and expel the bullet through the barrel 24 of the gun.

The foregoing description of pistol 10 summarizes the operation of a conventional magazine-fed pistol. The ensuing description sets forth the novel features of the ammunition supply indicating system incorporated into such pistol.

The ammunition supply indicating system includes components situated on the body 12 of the pistol, and cooperating components located on the magazine for the pistol. When the magazine is inserted into the hollow interior of the hand grip of the pistol, the components of the ammunition supply indicating system are mechanically and electronically united, and function together, in the prescribed fashion.

As elongated, relatively thin housing 40 is secured to the body of the gun above the hand grip 14, in proximity to slide 22. A display panel 42 is located at the rear of housing 40, and is clearly visible to the user of the gun. The housing may be tapered, as shown in FIG. 4, to minimize the likelihood that the housing will interfere with the holstering of the gun. Display panel 42 comprises a two digit display, with each digit being defined by seven segments. The two digits are vertically oriented, one above the other, to conserve space. Counters 44, 46, and decoders 48, 50 (shown in FIG. 7), for operating the two digits visible on display panel 42, are retained within housing 40.

A large on-off button 52 is located in the middle of the hand grip 14. When the pistol is held in its shooting position, the fingers of the user depress button 52 and complete the circuit to illuminate display panel 42. Ten seconds after the pressure on the switch is released, or at some other predetermined interval, the circuit opens and the power for illuminating the display panel 42 is shut off.

A small lithium battery 53 is retained in the hand grip 14 above on-off button 52. The battery powers a memory chip (not shown) which causes a flashing question mark to become visible, under certain operating conditions, on display panel 42. These operating conditions are discussed hereinafter.

As best shown in FIG. 3, a plurality of contact strips extend vertically upwardly along the interior walls of the hollow hand grip 14. The contact strips 54 are operatively associated with the counters 44, 46 which drive the two digits visible on display panel 42. Contact pads 56, which are wider than the strips 54, are formed at the lower ends of the strips.

A distinctive magazine 58 is provided for insertion into, and co-action with, the pistol shown in FIGS. 1–6. The magazine 58 has a metallic follower 60 that moves vertically between the interior walls of the magazine, which is sealed at its base and is open at its upper end. A spring (not shown) urges the follower upwardly. The pressure of the cartridges 62 in the magazine depresses the spring, and the spring delivers the cartridges, one at a time, into the firing chamber of the pistol. After the bullet has been fired, slide 22 retracts to expel the spent casing of the cartridge, and thus permits the introduction of the next cartridge into the chamber when the slide is moved forwardly. Only one cartridge 62 is shown in the magazine 58 in FIGS. 3 and 4, and the follower 60 is at its upper limit of travel.

Internal contact strips 64 are defined on opposing internal walls of the magazine, and the follower 60 rolls, or slides, therealong, to send a signal to the display panel representative of the number of cartridges, or rounds, presently held in the magazine. Contact strips 64 in the magazine 58 are canted in the same fashion as contact strips 54 in hand grip 14. Contact pads 66 are spaced outwardly from one outer wall of the magazine, as shown in FIG. 6. Pads 66 on the magazine 58 establish secure contact with the pads 54 at the lower end of hand grip 14.

An extender 68 depends from the body of the magazine 58. Extender 68 houses the electronic circuitry, including an 8-bit microprocessor 70 for operating the numeric display shown on display panel 42. Extender 68 also houses the so-called "pancake" batteries 72 that power the electronic circuitry. The rear surface of the extender 68 is sharply angled so that the arms and elbows of the user of the pistol do not contact same when the pistol is holstered, as shown in FIG. 2. The extender is wider than the body of magazine 58, and is identical, in width, to the hand grip.

Figure 7:
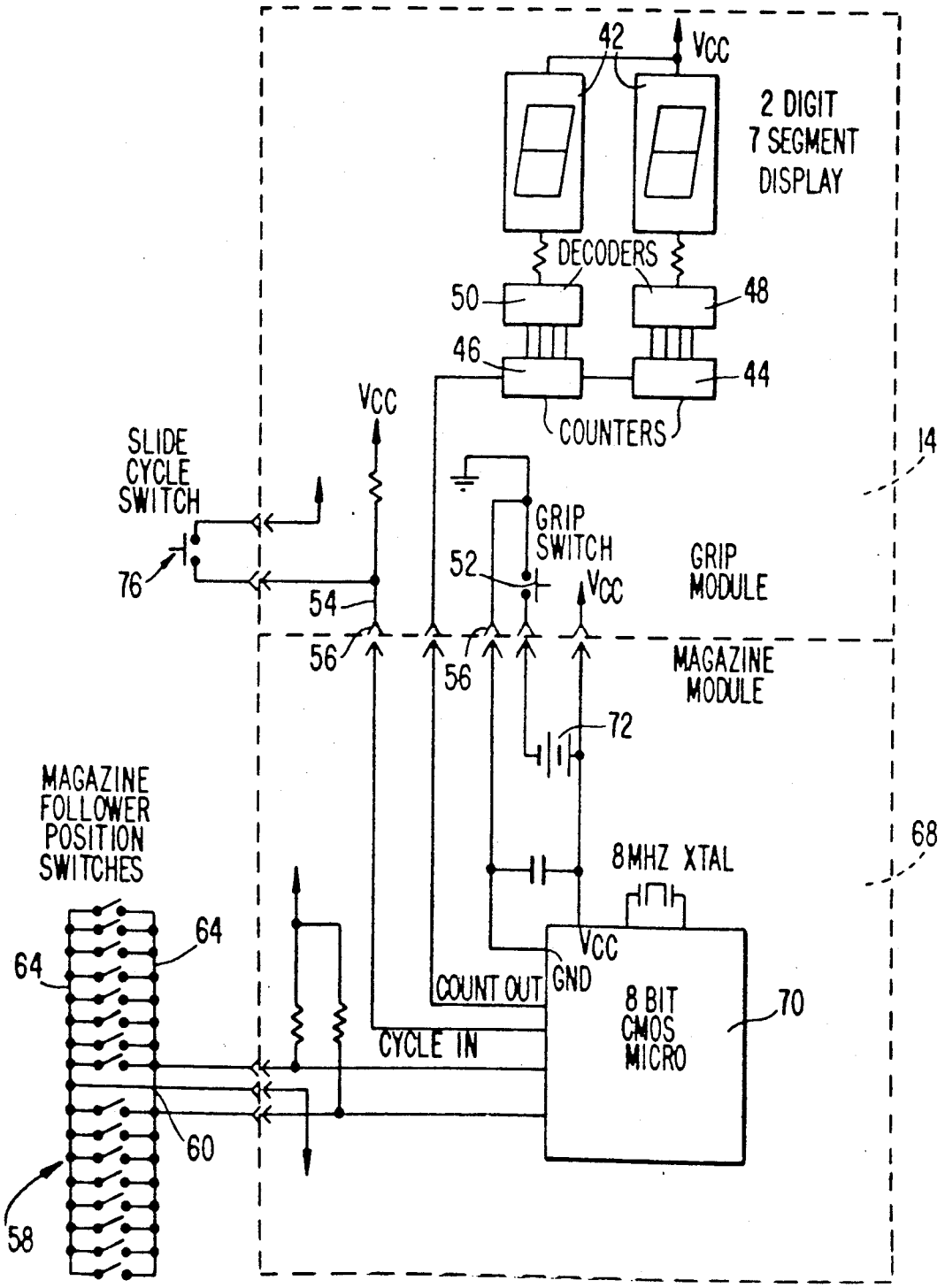
FIG. 7 is a schematic diagram of the circuitry for the ammunition supply indicating system of FIGS. 1–6.

When magazine 58 is slipped into the hollow interior of hand grip 14 of the pistol, the sliding movement of follower 60 along the contact strips 64 on the opposing interior walls of the magazine provides, through the circuitry of FIG. 7, an accurate count of the number of cartridges 62, or rounds, present in the magazine. However, in order to insure a reliable indication of the number of rounds available to the user of the gun, the round that is retained in the firing chamber must be considered, as well. This function may be accomplished in numerous ways correlated with the reciprocal, longitudinal movement of slide 22 relative to the body of the pistol.

To illustrate, as shown in FIG. 3, an elongated magnet 74 is secured to slide 22 below rear sight 28. A magnetically responsive solid-state device, such as a Hall-effect switch 76, is located between display housing 40 on the body of the pistol, and below aperture 32 in the slide. Magnet 74 normally does not affect switch 76, but when the slide 22 is moved forwardly from its rearward position of FIG. 1 to its forward position (of FIG. 3), switch 76 is operated. When operated, the switch 76 sends a signal to microprocessor 70 which, in turn, relays a count of "one" to the counter 44 and decoder 48 for viewing on display panel 42. When the slide 22 returns to its rearward position, the influence of magnet 74 is removed and switch 76 opens. The opening of the switch 76 decreases the count on display panel 42 by "one".

CYCLE OF OPERATION FOR PREFERRED EMBODIMENT OF FIGS. 1-7

If the pistol 10 is holstered, or is laid down, the display panel 42 is blank. When the user picks up the pistol 10 and grasps same in the usual fashion, on-off button 52 is depressed. If magazine 58 is retained in pistol 10, then display panel 42 is illuminated and reveals the number of rounds in the pistol before the pistol was laid down or holstered. In this regard, it should be noted that on-off button 52 controls the operation of microchip 70 and batteries 72 that are stored within the extender 68 to operate the display panel 42.

However, if magazine 58 is not present in the pistol 10, then the display panel is illuminated by depressing button 52, but a flashing question mark (not shown) is visible on display panel 42. The flashing question mark tells the user to check the firing chamber in the pistol. The system, in effect, is questioning whether, or not, a round 62 is in the firing chamber. The flashing question mark is powered by lithium battery 53 and a memory chip (not shown) powered by such battery, independently of the batteries 72 and microchip 70 found in the extender 62.

With the pistol being held normally, the user can observe either the number of rounds in the pistol, or the flashing question mark, on display panel 42. The user then moves slide 22 by hand, or by firing the pistol if a round is in the firing chamber. In either instance, the movement of slide 22 is detected, and such movement provides an "on" switch for the display panel. The flashing question mark is also cancelled, at the same time, assuming that such symbol had been flashing.

Consequently, when the slide 22 moves forwardly and closes the firing chamber, the display panel will reveal the total number of rounds 62 present in the pistol, not just the total number of rounds available in the magazine. The circuitry of FIG. 7 will detect the total number of rounds in the magazine, and then augment the count by adding "one" to that number. The "one" count represents the round 62 that has moved up, and out, of the magazine 58 and into the firing chamber.

DESCRIPTION OF ALTERNATIVE EMBODIMENTS

Figure 8:
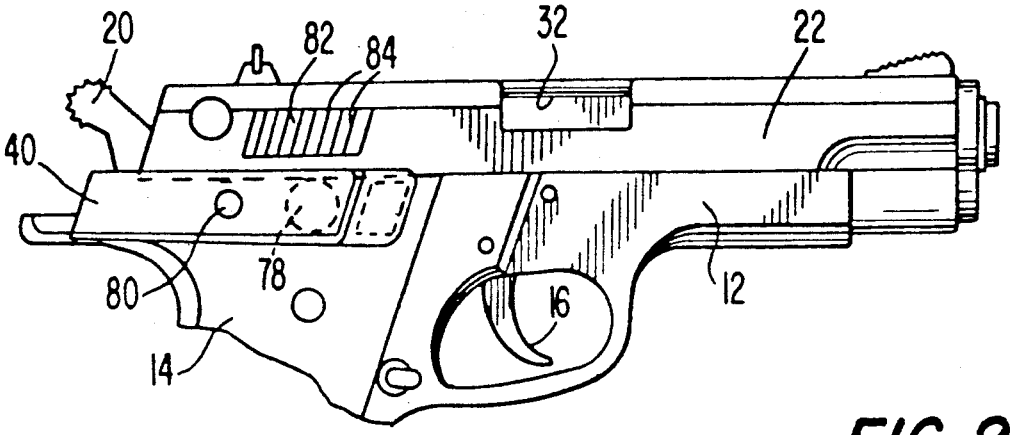
FIG. 8 is a fragmentary, right side elevational view of a magazine-fed pistol employing a second embodiment of the ammunition supply indicating system.

In lieu of magnet 74 and magnetically operated switch 76, FIG. 8 shows a mechanism for detecting the movement of slide 22 with equal facility. A friction wheel 78 is located on the housing 40 in frictional engagement with the underside of slide 22, as suggested by the dotted outline. The forward movement of slide 22 to close the firing chamber in the pistol imparts sufficient force to activate switch 76, add a "one" to the count, and render visible the display panel 42. Conversely, the rearward movement of slide 22 which opens or exposes the firing chamber and permits the ejection of a casing of a spent round or cartridge, reduces the count by "one".

A tally button 80 is also provided on housing 40, or some other location on the pistol that is easily accessible to the user of the gun. The tally button 80 is manually depressed as the rounds are introduced into the magazine so that the appropriate total will be shown on display panel 42. The tally button 80 is useful whenever a conventional magazine is inserted into the pistol, and unique magazine 58, shown in FIGS. 3, 5 and 6, is not utilized.

Figure 9:
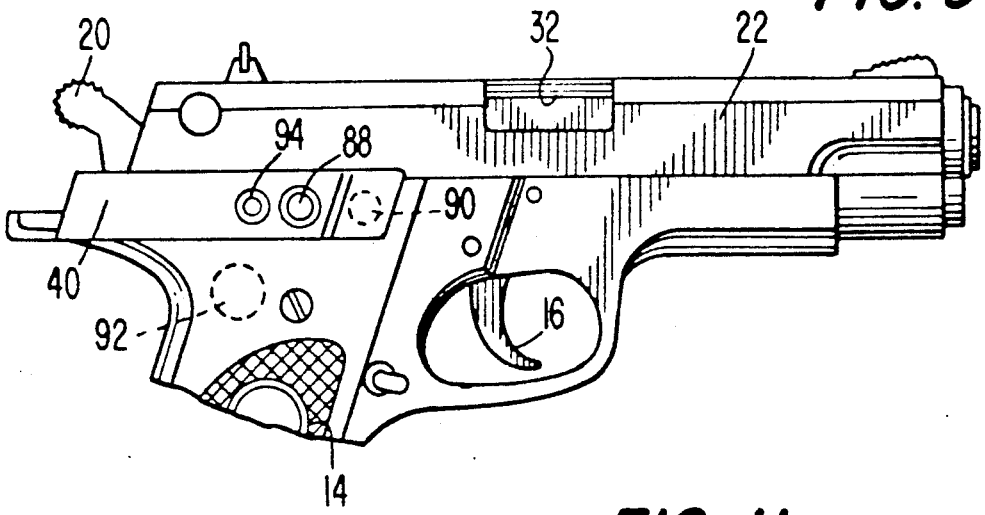
FIG. 9 is a fragmentary, right side elevational view of a magazine-fed pistol employing a third embodiment of the ammunition supply indicating system.

While the movement of slide 22 is detected by magnet 74 and switch 76 in the preferred embodiment of FIGS. 1-7, and the movement of slide 22 is detected by friction wheel 80 and switch 76 in the alternative embodiment of FIG. 8, other mechanisms are contemplated for such purpose. For example, a small source of light might be positioned within housing 40, and the light may reflect or bounce off the serrations, or ridges, 82 on the side of the slide, to be picked up by an optical sensor (not shown). Valleys 84 are defined between adjacent ridges, and the ridges and valleys from a saw-tooth or serrated configuration, when viewed from above. FIG. 9 illustrates a second alternative embodiment of the ammunition supply indicating system. In addition to a tally button 88 to manually run up the number of cartridges in the magazine, and a mechanism to add, or subtract, a "one" in response to the movement of slide 22, a sound transducer 90 is situated on the body of the gun in operative proximity to the firing chamber. Thus, when the pistol is fired, transducer 90 responds to the explosive impact and reduces the count appearing on display panel 42 in housing 40 by "one". In effect, transducer 90 verifies the total number of rounds appearing on display panel 42. In addition to transducer 90, a lithium battery 92 may be furnished as a separate power source for display panel 42, and a display erase button 94 may also be furnished.

Figure 10:
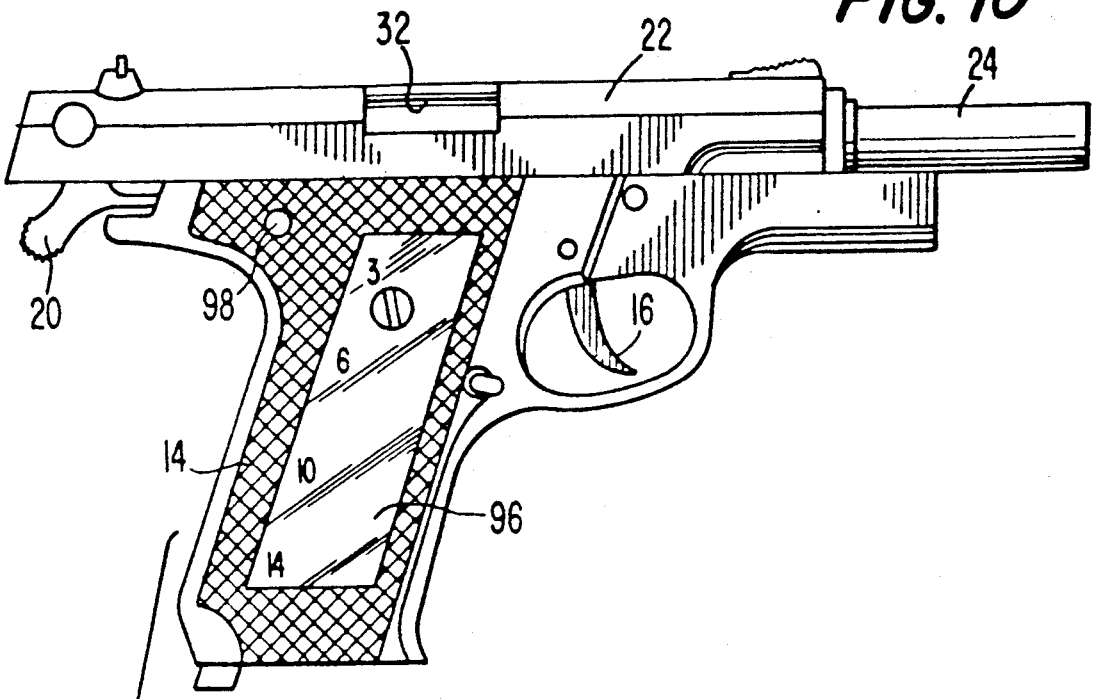
FIG. 10 is a right side elevational of a magazine-fed pistol employing a third embodiment of the invention, and further showing a magazine prior to insertion into the pistol.

FIG. 10 depicts a third alternative embodiment of the ammunition supply indicating system. A clear plastic window 96 is secured to at least one side of the pistol in place of hand grip 14, and the window is scored, or marked, with numbers from one to fourteen, the latter representing the rounds carried in the usual clip, or magazine, when filled to capacity. A button 98 is manually depressed to turn on a small light (not shown) to illuminate the interior of the hand grip of the pistol.

A magazine 100, with clear plastic sidewalls, fits into the handgrip so that the contents of the magazine can be observed through window 96. A metal base 102 is secured to the bottom of the magazine, and a metal follower 104 advances the cartridges, or rounds, serially through the magazine and into the firing chamber. A zig-zag spring 106 biases the follower, and the rounds supported thereabove, upwardly.

Figure 11:
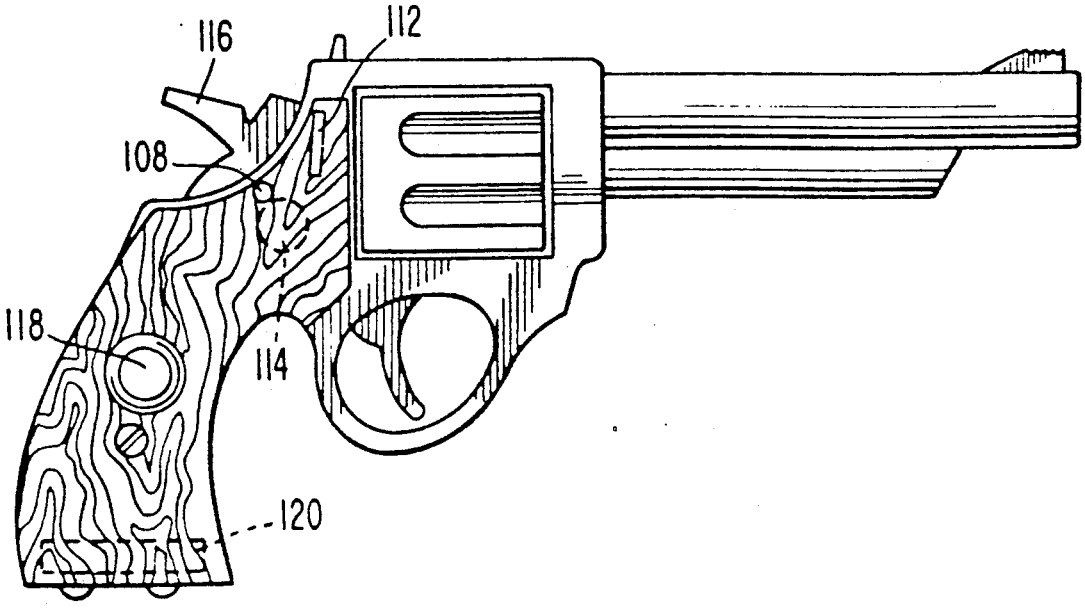
FIG. 11 shows a revolver employing a fourth embodiment of the ammunition supply indicating system.
Figure 12:
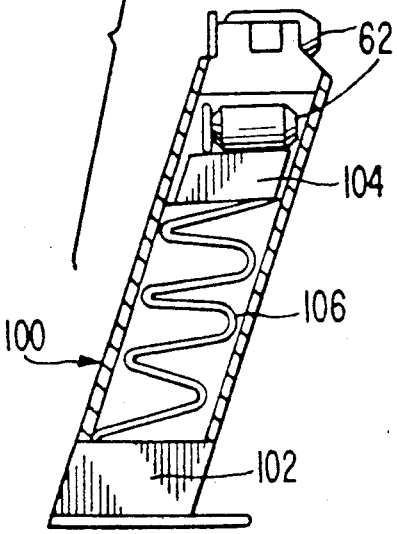
FIG. 12 is a fragmentary, perspective view of the revolver of FIG. 11.
Figure 12:
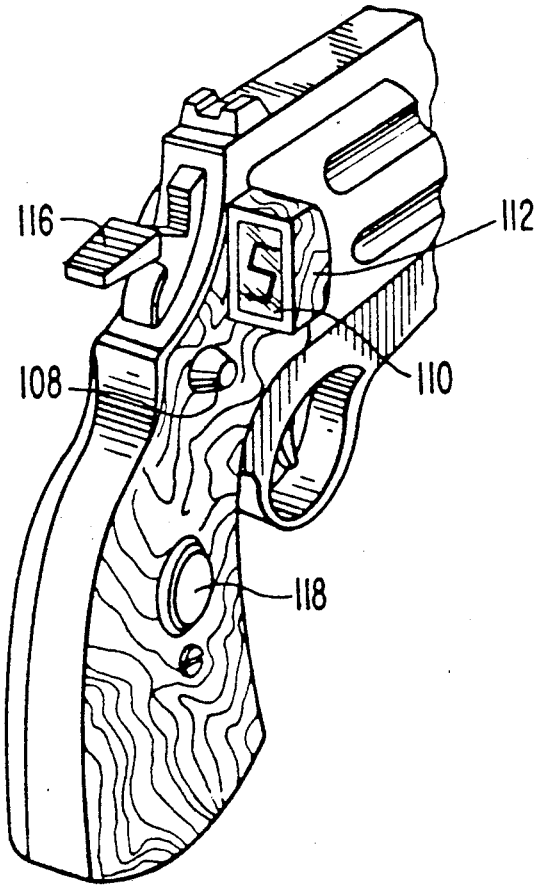

FIGS. 11-12 show a fourth alternative embodiment of the ammunition supply indicating system. Whereas the embodiments of FIGS. 1-7, 8, 9 and 10, all relied upon round counters used in conjunction with magazine fed pistols with a reciprocal slide 22, applicant's ammunition supply indicating system can be applied, with equal facility, to revolvers. To illustrate, a tally button 108 situated on the hand grip of the revolver is used to run up the count on the single digit display panel 10 in display housing 112. The housing is streamlined, and the display panel is located along the user's line of sight with the target.

A sound transducer 114 is located in proximity to the hammer 116, so that the transducer responds to the firing of 1 round and reduces the count appearing on display 110 in an appropriate manner. A large on-off button 118 actuates the display electronics when depressed, as by the fingers of the user gripping the gun. The power source, such as batteries 120, for the display electronics, is housed in the lower end of the handgrip of the revolver.

While the foregoing description has described one preferred embodiment, and four alternative embodiments, of an ammunition supply indicating system, further modifications, alterations, and revisions, are possible without departing from the scope of the invention. For example, the display housing could be mounted for pivotal movement; in such fashion, each user of the pistol could adjust the display panel to a position most comfortable to him, or her. The taper on the magazine extender could be increased, or diminished, to facilitate insertion of the pistol into a holster. While several methods of sensing the number of rounds within a magazine have been disclosed, another proposed method would employ a sensor within the follower itself, and thus would obviate the need for the follower to cooperate with contact strips formed on the interior walls of the magazine. Also, while the round counters have been shown in operative relationship to magazine fed pistols and revolvers, applicant's ammunition supply indicating systems have broader applicability, and may be used with all types of magazine fed firearms including rifles, shotguns, machine guns, auto-pistols, Uzis, etc.

Consequently, the appended claims should be broadly construed in a manner commensurate with the breadth of the invention, and should not be limited to their literal terms.

I claim:

1. In combination, a firearm and an ammunition supply indicating system for counting the number of rounds available for discharge from a firearm, the combination comprising:

a) a firearm including a body, a handgrip, a barrel, a slide mounted for reciprocal movement along said barrel, a trigger, and means operated by said trigger for moving said slide in at least one direction, b) a firing chamber defined in said barrel, and said slide having an aperture movable into alignment with said chamber during the travel of said slide, c) a magazine adapted to receive cartridges to be discharged through the barrel upon actuation of the trigger, d) a follower in said magazine, and a spring for urging the follower to deliver a cartridge into the firing chamber, e) the ammunition supply indicating system comprising:

1) means operatively associated with said slide for detecting movement thereof to alternately expose and seal said firing chamber, 2) switch means in said magazine for monitoring the movement of the follower therewithin, and producing a signal indicative of the position of the follower, 3) electronic circuit means for combining the signals indicative of movement of said slide and said follower, and 4) display means operated by said electronic circuit means to display a running total of the number of rounds available in said firearm for discharge.

2. The ammunition supply indicating system as defined in claim 1 wherein said means for detecting slide movement comprises a magnet affixed to said slide and a magnetically operated element affixed to said body of said firearm.

3. The ammunition supply indicating system as defined in claim 2 wherein said magnet is secured to the rear end of the slide behind the aperture, while said magnetically operated element is located on said body forward of said hand grip, so that said element is operated only when said slide is moved forwardly to close the firing chamber.

4. The ammunition supply indicating system as defined in claim 1 wherein said means for detecting slide movement comprises a friction wheel secured to the body of said firearm in contact with the lower surface of said slide.

5. The ammunition supply indicating system as defined in claim 1 wherein said means for detecting slide movement includes a series of serrations defined on the side of said slide, a light source positioned on said body to illuminate the serrations, and an optical detector to receive the reflected light when the serrations move past the detector as the slide travels.

6. The ammunition supply indicating system as defined in claim 1 wherein said switch means in said magazine comprises contact strips secured to opposite, interior walls of said magazine and cooperating contacts on said follower.

7. The ammunition supply indicating system as defined in claim 1 wherein said electronic circuit means includes a microprocessor and a power source, said electronic circuit means being retained in an extender secured to the base of said magazine.

8. The ammunition supply indicating system as defined in claim 7 wherein said electronic circuit means further includes a sound transducer located in proximity to said firing chamber, said transducer responding to explosive sounds in the firing chamber to verify that a round has been discharged from the firearm.

9. The ammunition supply indicating system as defined in claim 6 wherein said handgrip of said firearm is hollow and is configured to receive said magazine therewithin, and contact strips are situated within said handgrip, said contact strips on said magazine being mechanically and electronically connected to said contact strips in said handgrip, thereby enabling said electronic circuit means.

10. The ammunition supply indicating system as defined in claim 1 wherein said display means includes a display housing secured to said firearm in proximity to said handgrip and in the line of sight of the user, and a display panel is situated in the housing and is visible to the user.

11. The ammunition supply indicating system as defined in claim 10 wherein said display panel has a two-digit capacity, the digits being vertically spaced to conserve space.

12. The ammunition supply indicating system as defined in claim 10 wherein said display housing is pivotally secured to said body of the firearm for angular adjustment relative to the user.

13. The ammunition supply indicating system as defined in claim 10 further including a first independent power source for said display means, and an on-off switch incorporated into said handgrip, said switch being depressed by the user grasping the handgrip of the firearm so that said display means is turned on.

14. The ammunition supply indicating system as defined in claim 13 wherein a microchip and a second independent power source for powering said chip are situated in said hand grip between said on-off switch and said slide, said chip controlling a flashing symbol that appears on said display panel under certain operating conditions.

15. The ammunition supply indicating system as defined in claim 14 wherein said flashing symbol is turned off by movement of said slide in a first direction, and said display means is turned on by the same movement.

16. The ammunition supply indicating system as defined in claim 1 wherein said display means is located in the line of sight of the user toward the target.

17. In combination, a firearm including a reciprocal slide and a mechanism for detecting the movement of said slide, the combination comprising:

a) a firearm including a body, a handgrip, a barrel, a slide mounted for reciprocal movement along said barrel, a trigger, and means operated by said trigger for moving said slide in at least one direction, b) a firing chamber defined in said barrel, c) said slide having an aperture defined therein, said slide being movable so that said aperture is in alignment with said firing chamber during the travel of said slide, d) a magazine in said handgrip adapted to receive rounds to be discharged through the barrel of said firearm in response to operation of said trigger, e) means operatively associated with said slide for detecting movement thereof to open and close said firing chamber, and f) said last-mentioned means comprising a magnet affixed to said slide and a magnetically operated element affixed to said body of said firearm.

18. The mechanism as defined in claim 17 wherein said magnet is secured to the rear end of said slide behind the aperture, and said magnetically operated element is located on said body of said firearm forward of said handgrip, so that said element is operated only when said slide is moved to close the firing chamber.

19. In combination, a firearm including a reciprocal slide and a mechanism for detecting the movement of said slide, the combination comprising:

a) a firearm including a body, a handgrip, a barrel, a slide mounted for reciprocal movement along said barrel, a trigger, and means operated by said trigger for moving said slide in at least one direction, b) a firing chamber defined in said barrel, c) said slide having an aperture defined therein, said slide being movable so that said aperture is in alignment with said firing chamber during the travel of said slide, d) a magazine in said housing adapted to receive rounds to be discharged through the barrel of said firearm in response to operation of said trigger, e) means operatively associated with said slide for detecting movement thereof to open and close said firing chamber, and f) said last-mentioned means comprising a friction wheel secured to said body of said firearm in contact with the lower surface of said slide.

20. In combination, a firearm including a reciprocal slide and a mechanism for detecting the movement of said slide, the combination comprising:

a) a firearm including a body, a handgrip, a slide mounted for reciprocal movement along said barrel, a trigger, and means operated by said trigger for moving said slide in at least one direction, b) a firing chamber defined in said barrel, c) said slide having an aperture defined therein, said slide being movable so that said aperture is in alignment with said firing chamber during the travel of said slide, d) a magazine in said housing adapted to receive rounds to be discharged through the barrel of said firearm in response to operation of said trigger, e) means operatively associated with said slide for detecting movement thereof to open and close said firing chamber, and f) said last-mentioned means comprising a series of serrations on said slide near the rear end thereof, a light source secured to said handgrip and focused on said serrations, and an optical sensor for receiving the light beams reflected from said serrations as said slide travels back and forth.

21. A method of counting and displaying the number of rounds available for discharge from a firearm, 1) said firearm including a body, a hollow handgrip, a barrel, a slide mounted for reciprocal movement along said barrel, a trigger, and means operated by said trigger for moving said slide in at least one direction, 2) a firing chamber defined in said barrel, 3) an aperture in said slide that exposes said firing chamber during its reciprocal movement, and 4) circuit means located within said firearm for counting and displaying the number of rounds available for discharge from the firearm, the method comprising the steps of:

a) counting the number of rounds contained in said magazine when said magazine is inserted into said handgrip and entering such number into said circuit means, b) automatically adding a count of "one" to account for the possibility that a round is present in the firing chamber when the slide moves in a first direction, c) electronically combining in said circuit means the total number of rounds contained in the magazine and the firing chamber, and d) displaying the total number of rounds on a display visible to the user of said firearm and in the line of sight from the user to a target.

22. The method of counting and displaying the number of rounds available for discharge from a firearm as defined in claim 21, further comprising the step of:

e) subtracting a count of "one" when the slide moves in the second, opposite direction.

23. The method of counting and displaying the number of rounds available for discharge as defined in claim 21 wherein at least one tally button is provided on said firearm, said tally button being manually depressed by the user of the firearm to indicate the number of rounds in the magazine.

24. The method of counting and displaying the number of rounds available for discharge as defined in claim 21 wherein motion sensing means are operatively associated with said slide to detect movement thereof in both directions, and to adjust the total number of rounds accordingly.

25. The method of counting and displaying the number of rounds available for discharge from a firearm as defined in claim 21 further including the step of:

f) forming complementary contacts on said magazine and within said handgrip so that the method of counting and displaying the number of rounds cannot be initiated until the magazine is inserted into said handgrip.

26. The method of counting and displaying the number of rounds available for discharge from a firearm as disclosed in claim 25 includes positioning a follower and a spring for biasing same upwardly within the magazine, said follower cooperating with said contacts to furnish a running count of the number of rounds contained in said magazine.

* * * * *